US009644583B2

(12) United States Patent
Ishiki et al.

(10) Patent No.: US 9,644,583 B2
(45) Date of Patent: May 9, 2017

(54) FUEL PIPE PROTECTIVE STRUCTURE

(71) Applicant: HONDA MOTOR CO., LTD., Tokyo (JP)

(72) Inventors: Kazuya Ishiki, Wako (JP); Eiji Nishijima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 103 days.

(21) Appl. No.: 14/505,498

(22) Filed: Oct. 3, 2014

(65) Prior Publication Data

US 2015/0101696 A1 Apr. 16, 2015

(30) Foreign Application Priority Data

Oct. 15, 2013 (JP) ..... 2013-214352

(51) Int. Cl.
*F02M 37/00* (2006.01)

(52) U.S. Cl.
CPC ..... *F02M 37/0017* (2013.01)

(58) Field of Classification Search
CPC ..... B60R 2021/0004; B60R 21/0136; F02D 41/021; F02M 2200/185; F02M 37/0017; F02M 35/10216; F02M 35/10354
USPC ..... 123/445, 198 R, 198 E, 138, 109, 110, 123/155, 125
See application file for complete search history.

(56) References Cited

U.S. PATENT DOCUMENTS 5,016,670 A * 5/1991 Sasaki ..... B60K 15/077 123/514
5,380,042 A * 1/1995 Hively ..... B60K 15/067 220/562
6,776,132 B2 * 8/2004 Kudo ..... F02M 35/10111 123/184.42
7,392,782 B2 * 7/2008 Fujii ..... F02M 35/10144 123/195 C
2004/0159302 A1 * 8/2004 Horibe ..... F02M 35/10078 123/195 C
2011/0084476 A1 * 4/2011 Nishida ..... F02M 55/00 285/45

FOREIGN PATENT DOCUMENTS

JP 2004360581 A * 12/2004
JP 2011-185228 9/2011

OTHER PUBLICATIONS

Machine translation of JP2004360581A, see "JP2004360581A_ MachineTranslation.pdf", published Dec. 2004.*

* cited by examiner

*Primary Examiner* — Long T Tran
(74) *Attorney, Agent, or Firm* — Mori & Ward, LLP

(57) ABSTRACT

A fuel pipe protective structure includes a fuel pipe, a connecting member, and a protective member. The protective member is to protect a connection between the fuel pipe and the connecting member. The protective member includes a base and a cover. The base is to be connected to a vehicle body wall that defines an engine compartment. The cover is to be interposed between the connection and an internal combustion engine so as to cover the connection. The cover includes a guide. The guide is configured to cause the protective member to be plastically deformed in order to displace the connection in a receding direction in which the connection moves to avoid being caught by the internal combustion engine in a case where the internal combustion engine moves toward a vehicle interior upon collision of the vehicle.

18 Claims, 11 Drawing Sheets

FUEL PIPE PROTECTIVE STRUCTURE

CROSS-REFERENCE TO RELATED APPLICATIONS

The present application claims priority under 35 U.S.C. §119 to Japanese Patent Application No. 2013-214352, filed Oct. 15, 2013, entitled "Fuel Pipe Protective Structure." The contents of this application are incorporated herein by reference in their entirety.

BACKGROUND

1. Field

The present disclosure relates to a fuel pipe protective structure.

2. Description of the Related Art

A fuel pipe is connected to an internal combustion engine mounted in an engine compartment. The fuel pipe disposed in the engine compartment is often disposed closer to a vehicle interior than the internal combustion engine so that the fuel pipe is less likely to be broken upon collision of a vehicle. Specifically, the fuel pipe is often disposed behind the internal combustion engine in a front-engine vehicle.

However, the internal combustion engine may move toward the vehicle interior within the engine compartment at the time of collision of the vehicle. If a fuel supply component, such as a control valve, connected to an upstream end of the fuel pipe is disposed closer to the vehicle interior than the internal combustion engine, the internal combustion engine would interfere with the fuel supply component. Unfortunately, the fuel supply component would be broken. Japanese Unexamined Patent Application Publication No. 2011-185228 discloses a structure for preventing a fuel supply component disposed near an internal combustion engine from being broken due to interference with the internal combustion engine. In this structure, a cover for the internal combustion engine has a sloping surface that slopes downward in a direction (hereinafter, referred to as "engine moving direction") in which the internal combustion engine would move at the time of collision. The fuel supply component is positioned such that a lower surface of the fuel supply component is disposed at a higher level than an edge of the sloping surface of the cover in the engine moving direction. Consequently, if the internal combustion engine moves, the fuel supply component will slide on the sloping surface so as to move upward.

SUMMARY

According to one aspect of the present invention, a fuel pipe protective structure includes a fuel pipe, a connecting member, and a protective member. The fuel pipe has a first end connected to an internal combustion engine mounted in an engine compartment of a vehicle and a second end disposed closer to a vehicle interior than the internal combustion engine. The connecting member is connected to the second end of the fuel pipe. The protective member protects a connection between the fuel pipe and the connecting member. The protective member includes a base fixed to a vehicle body wall that defines the engine compartment, and a cover interposed between the connection and the internal combustion engine so as to cover the connection. The cover includes a guide that causes the protective member to be plastically deformed in order to displace the connection in a receding direction in which the connection recedes to avoid being caught by the internal combustion engine when the internal combustion engine moves toward the vehicle interior upon collision of the vehicle.

According to another aspect of the present invention, a fuel pipe protective structure includes a fuel pipe, a connecting member, and a protective member. The fuel pipe has a first end to be connected to an internal combustion engine mounted in an engine compartment of a vehicle and a second end disposed closer to a vehicle interior than the internal combustion engine. The connecting member is connected to the second end of the fuel pipe. The protective member is to protect a connection between the fuel pipe and the connecting member. The protective member includes a base and a cover. The base is to be connected to a vehicle body wall that defines the engine compartment. The cover is to be interposed between the connection and the internal combustion engine so as to cover the connection. The cover includes a guide. The guide is configured to cause the protective member to be plastically deformed in order to displace the connection in a receding direction in which the connection moves to avoid being caught by the internal combustion engine in a case where the internal combustion engine moves toward the vehicle interior upon collision of the vehicle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
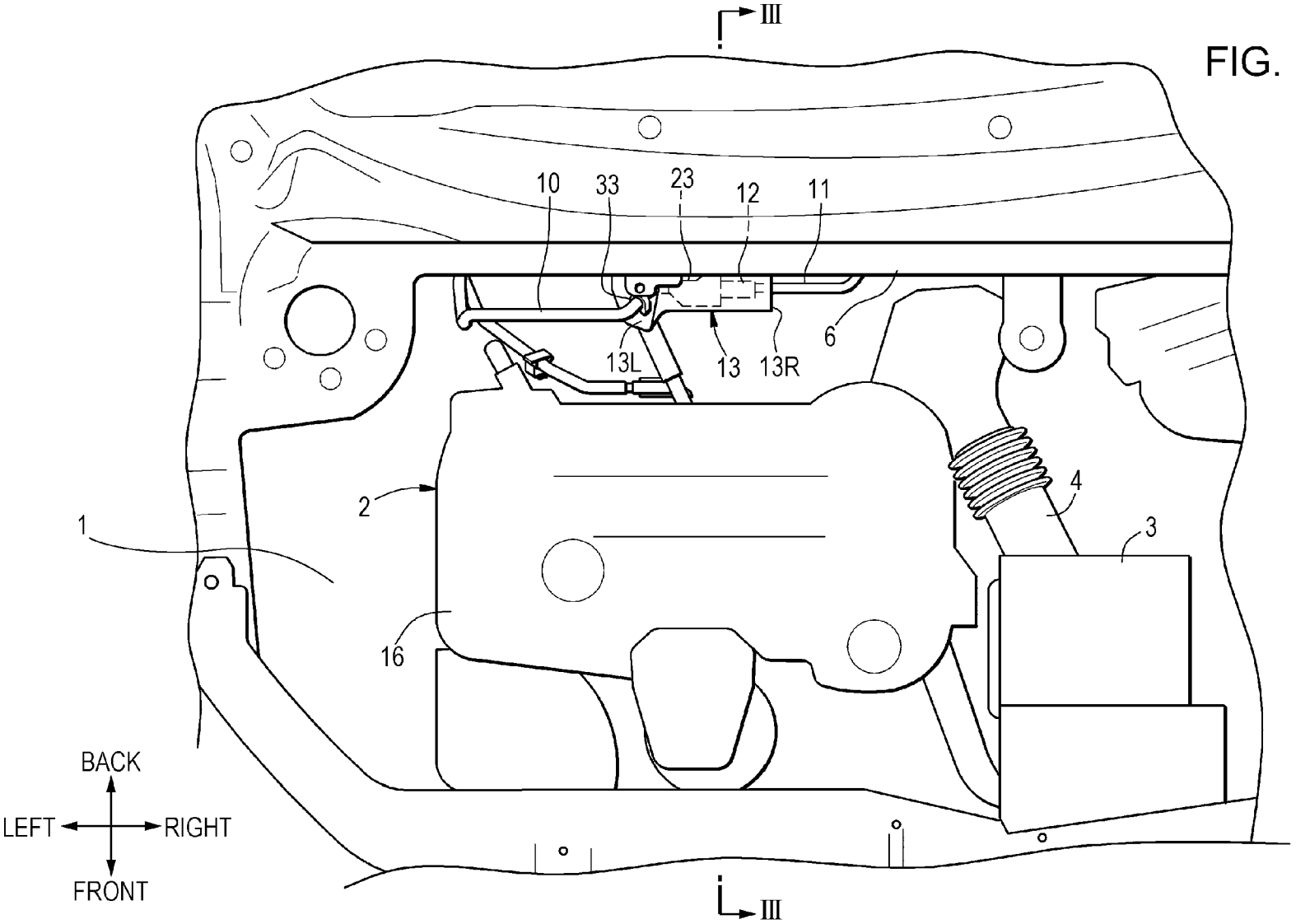
FIG. 1 is a plan view of an engine compartment in a first embodiment.

The embodiments will now be described with reference to the accompanying drawings, wherein like reference numerals designate corresponding or identical elements throughout the various drawings.

Embodiments will be described in detail with reference to the drawings. In the following description, it is assumed that a fuel pipe protective structure according to the present disclosure is applied to a front-engine vehicle in which an internal combustion engine 2 is mounted in an engine compartment 1 in front part of a vehicle. The terms "front" and "back" as used herein are intended to indicate directions with respect to the traveling direction of the vehicle. The terms "right" and "left" as used herein are intended to indicate directions with respect to the direction when viewed from the front of the vehicle.

First Embodiment

A protective structure for a fuel pipe 10 according to a first embodiment will now be described with reference to FIGS. 1 to 8D. Referring to FIG. 1, an in-line multicylinder internal combustion engine 2 is transversely mounted in substantially the middle of an engine compartment 1 in a direction (hereinafter, referred to as the "vehicle length direction") along the length of a vehicle such that the internal combustion engine 2 is placed slightly to the right of the engine compartment 1. In the engine compartment 1, an air cleaner 3 is disposed on the right side of the internal combustion engine 2. An intake pipe 4 extending backward from the air cleaner 3 is connected to a rear surface of the internal combustion engine 2. A vehicle interior is located behind the engine compartment 1. A front bumper (not illustrated) is disposed in front of the engine compartment 1.

Figure 2:
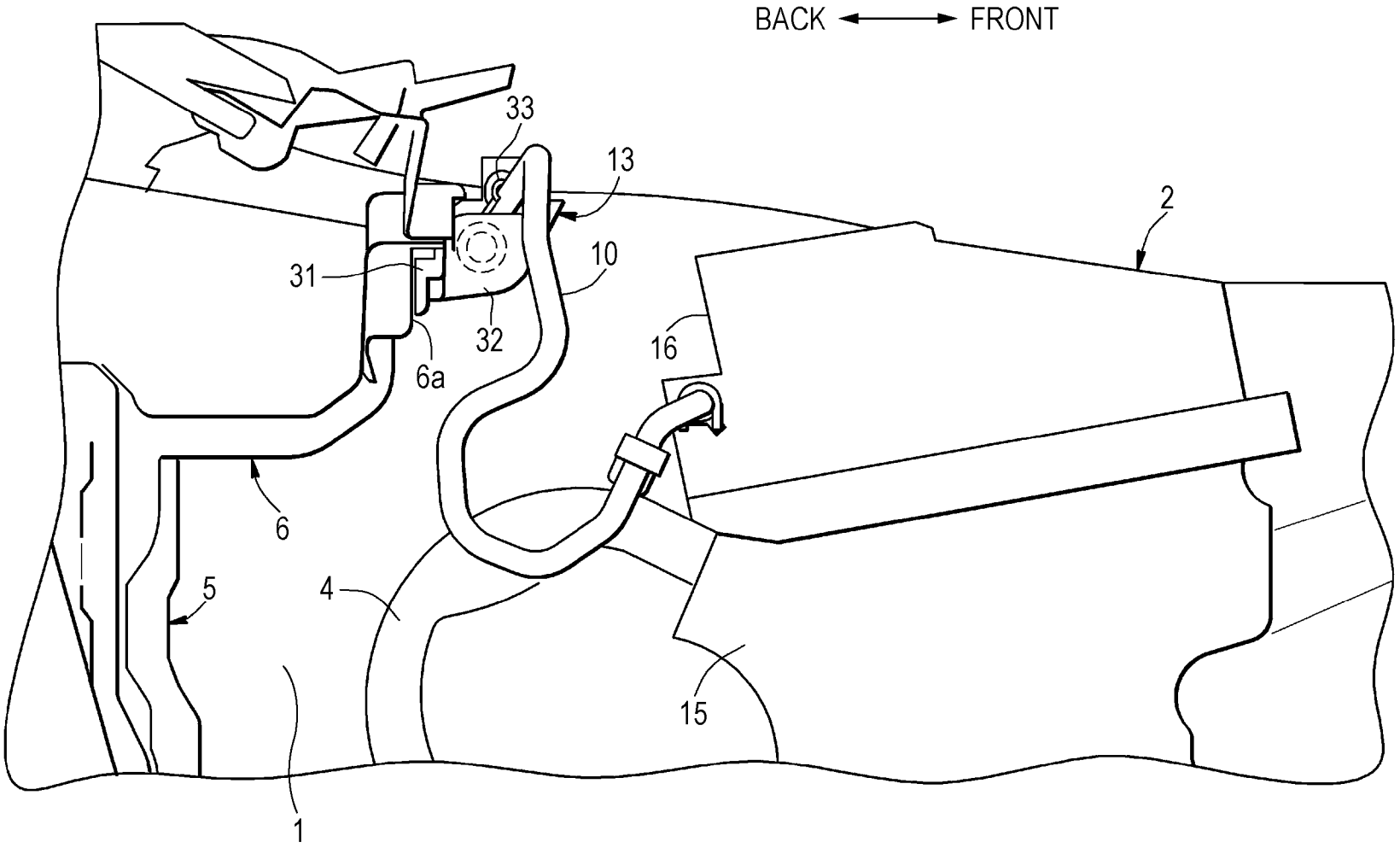
FIG. 2 is a side view illustrating a fuel pipe protective structure illustrated in FIG. 1.

As illustrated in FIG. 2, the engine compartment 1 is separated from the vehicle interior by a dashboard lower member 5. An upper end of the dashboard lower member 5 is connected to a dashboard upper member 6 extending substantially in the vehicle length direction and a direction (hereinafter, referred to as the "vehicle width direction") along the width of the vehicle. A hood (not illustrated) that defines an upper portion of the engine compartment 1 is disposed above the dashboard upper member 6. The rear surface of the internal combustion engine 2 is connected to a downstream portion of a fuel supply system for supplying fuel, compressed and delivered through a fuel pump (not illustrated), from a fuel tank (not illustrated), to the internal combustion engine 2.

The fuel supply system includes the fuel pipe 10, made of metal, having a downstream end connected to the internal combustion engine 2 and a resin feed hose 11 connected to an upstream end of the fuel pipe 10 with a connection unit 12. The connection unit 12 is disposed so as to extend in the vehicle width direction in front of the dashboard upper member 6. The connection unit 12 is housed in a protective member 13 for protecting the connection unit 12. The protective member 13 has a right opening 13R which faces rightward at a right end of the protective member 13 and a left opening 13L which faces leftward, upward, and forward at a left end thereof. The feed hose 11 extends substantially horizontally and rightward from the right opening 13R of the protective member 13. The fuel pipe 10 extends obliquely upward and obliquely forward from the left opening 13L of the protective member 13, curves and extends downward, curves and extends backward, curves so as to protrude backward and downward, extends obliquely forward and obliquely leftward, and connects to the internal combustion engine 2. As described above, the fuel pipe 10 is connected to the internal combustion engine 2 without passing through the shortest path. Consequently, if the connection unit 12 is displaced upon collision of the vehicle, the fuel pipe 10 would not be broken by tension as will be described later.

Figure 3:
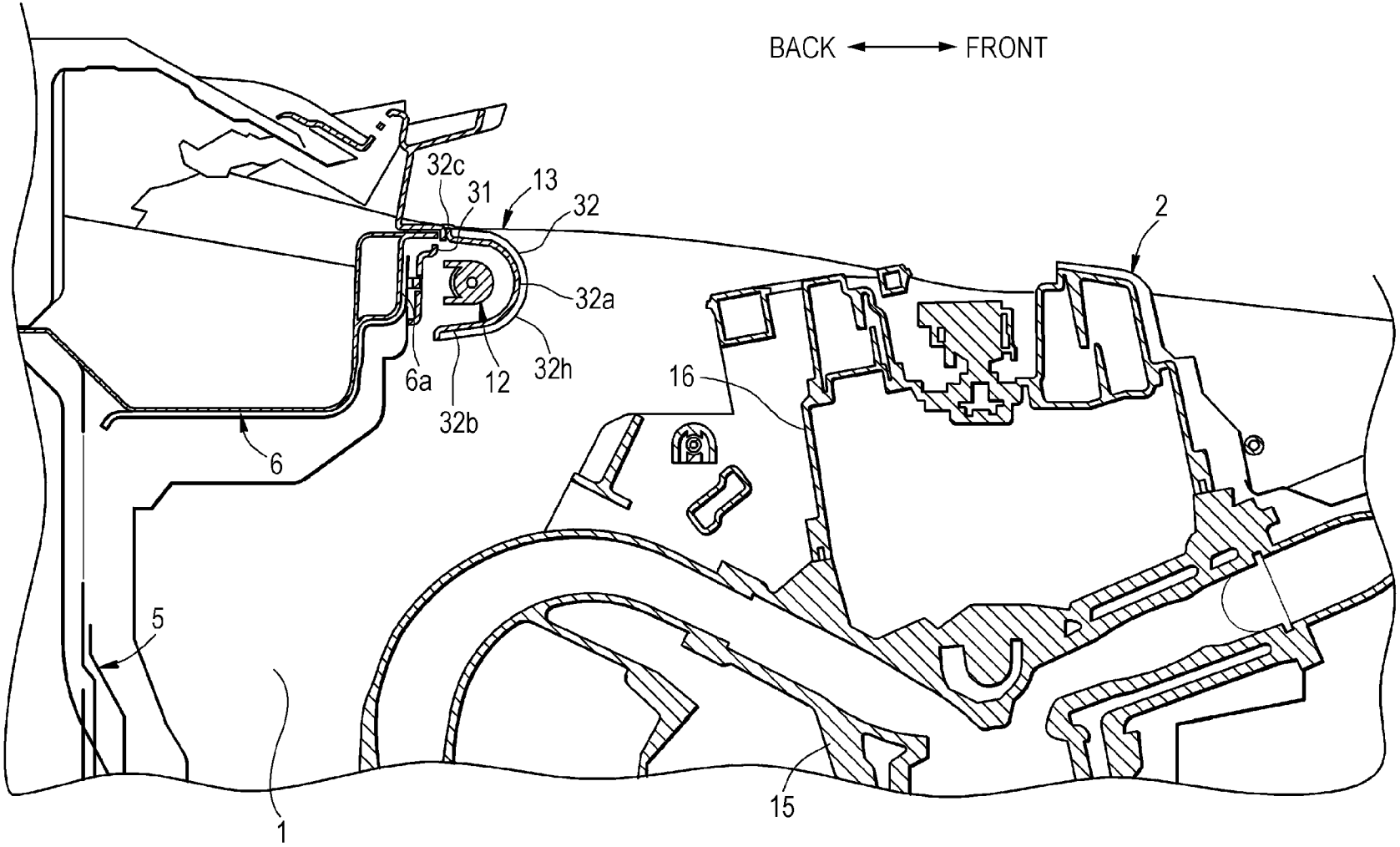
FIG. 3 is a cross-sectional view of components taken along the line in FIG. 1.

Referring to FIG. 3, the internal combustion engine 2 is disposed in a backward tilted state such that an upper portion is tilted backward. An upper surface of an engine body 15 including a cylinder block and a cylinder head is covered with a head cover 16. Upper part of the head cover 16 is disposed in front of the dashboard upper member 6 having a substantially rectangular box shape in cross section. The intake pipe 4 extending upward is located behind the engine body 15. Downstream part of the intake pipe 4 curves forward and connects to a rear surface of the engine body 15 (cylinder head). The protective member 13, which houses the connection unit 12, is positioned at substantially the same level as that of an upper end of a rear surface of the head cover 16. The protective member 13 is fixed to a front wall 6*a* of the dashboard upper member 6. The front wall 6*a* extends substantially vertically.

The connection unit 12 may have a well-known structure for connecting the fuel pipe 10 and the feed hose 11. The structure of the connection unit 12 and a procedure of connecting the fuel pipe 10 and the feed hose 11 with the connection unit 12 will now be described roughly.

Figure 4:
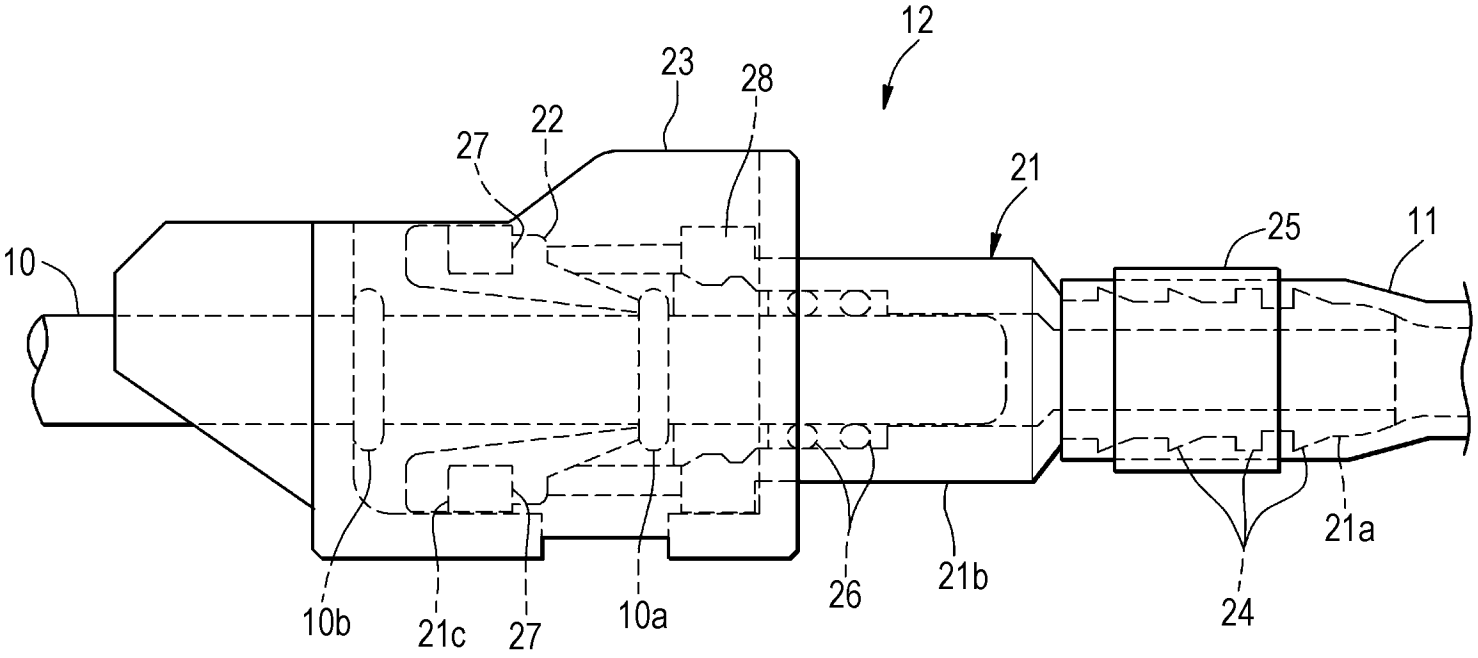
FIG. 4 is a front view of a connection (or connection unit) illustrated in FIG. 3.

As illustrated in FIG. 4, the connection unit 12 includes a resin connector 21 secured to the end of the fuel pipe 10 and a locking member 22. The connector 21 is substantially cylindrical. The connector 21 has a first end portion through which the downstream end of the fuel pipe 10 extends and a second end portion over which an upstream end of the feed hose 11 is fitted. The fuel pipe 10 and the connector 21 are secured relative to each other by the locking member 22. To prevent the connector 21 from being separated from the fuel pipe 10, a resin anti-separation holder 23 is attached to the fuel pipe 10 and the connector 21 so as to extend over both of them.

Specifically, the fuel pipe 10 and the feed hose 11 are connected by the connection unit 12 as follows. The fuel pipe 10 includes a first flange 10*a* and a second flange 10*b* arranged in that order from the end (downstream end) of the pipe and spaced apart from each other at a predetermined distance. Each of the first flange 10*a* and the second flange 10*b* annularly protrudes radially outward from the fuel pipe 10. The connector 21 includes a small diameter portion 21*a*, an intermediate diameter portion 21*b*, and a large diameter portion 21*c* arranged in that order from the end thereof adjacent to the feed hose 11. The small diameter portion 21*a* has annular ribs 24 on an outer circumferential surface thereof so that the feed hose 11 fitted over the small diameter portion 21*a* is not prone to separate therefrom. A band 25 is attached to an outer circumferential surface of the feed hose 11 fitted over the small diameter portion 21*a*. The feed hose 11 is prevented from being separated from the small diameter portion 21*a* by tightening the band 25. The intermediate diameter portion 21*b* is used for connection with the fuel pipe 10. The fuel pipe 10 is fitted directly in the intermediate diameter portion 21*b* or indirectly fitted within the intermediate diameter portion 21*b* with a pair of O-rings arranged between the fuel pipe 10 and the intermediate diameter portion 21*b*. The large diameter portion 21*c* has a pair of openings 27 arranged vertically in FIG. 4. The large diameter portion 21*c* functions as an engagement unit to allow the locking member 22 to engage with the openings 27 so as to define a relative position of the locking member 22. A seal 28 is disposed within the large diameter portion 21*c* such that the seal 28 is interposed between the fuel pipe 10 and the large diameter portion 21*c* adjacent to the intermediate diameter portion 21*b*. The first flange 10*a* of the fuel pipe 10 is located next to the seal 28. A distal end of the locking member 22 engages with the first flange 10*a*, thus positioning the fuel pipe 10 relative to the locking member 22, or the connector 21.

The locking member 22 is elastically deformable. Specifically, the distal end of the locking member 22 to engage with the first flange 10*a* is deformable radially outward so that the fuel pipe 10 can be inserted to a predetermined position while the locking member 22 is attached to the connector 21. Furthermore, a proximal portion of the locking member 22 to engage with the openings 27 of the connector 21 is deformable radially inward so that the locking member 22 can be easily disengaged from the openings 27 by grasping a proximal end of the locking member 22 projecting from the connector 21.

The second flange 10*b* of the fuel pipe 10 is located closer to a proximal end of the fuel pipe 10 than the locking member 22 so that the second flange 10*b* does not interfere with the locking member 22 when the locking member 22 is disengaged from the connector 21. The anti-separation holder 23 is attached to the fuel pipe 10 and the connector 21 such that the holder 23 engages with a face of the second flange 10*b* of the fuel pipe 10 adjacent to the proximal end of the fuel pipe 10 and also partly engages with a shoulder provided between the large diameter portion 21*c* and the intermediate diameter portion 21*b* of the connector 21. Consequently, the connector 21 is prevented from being separated from the fuel pipe 10. The detailed structure of the connector 21 and a procedure of detaching the connector 21 are described in Japanese Unexamined Patent Application Publication No. 2008-309187, the entire contents of which are incorporated herein by reference.

As described above, the fuel pipe 10 and the connector 21 are doubly connected by the locking member 22 and the anti-separation holder 23, and the connector 21 and the feed hose 11 are doubly connected by the annular ribs 24 of the small diameter portion 21*a* and the band 25. If front part of a vehicle body is crashed due to a vehicle collision and the internal combustion engine 2 moves backward, or toward the vehicle interior within the engine compartment 1, the connection unit 12 may be caught between the dashboard upper member 6 and the internal combustion engine 2 and accordingly be broken. Unfortunately, fuel may leak from a broken part. According to the first embodiment, therefore, the protective member 13 for protecting the connection unit 12 is disposed.

Figure 5:
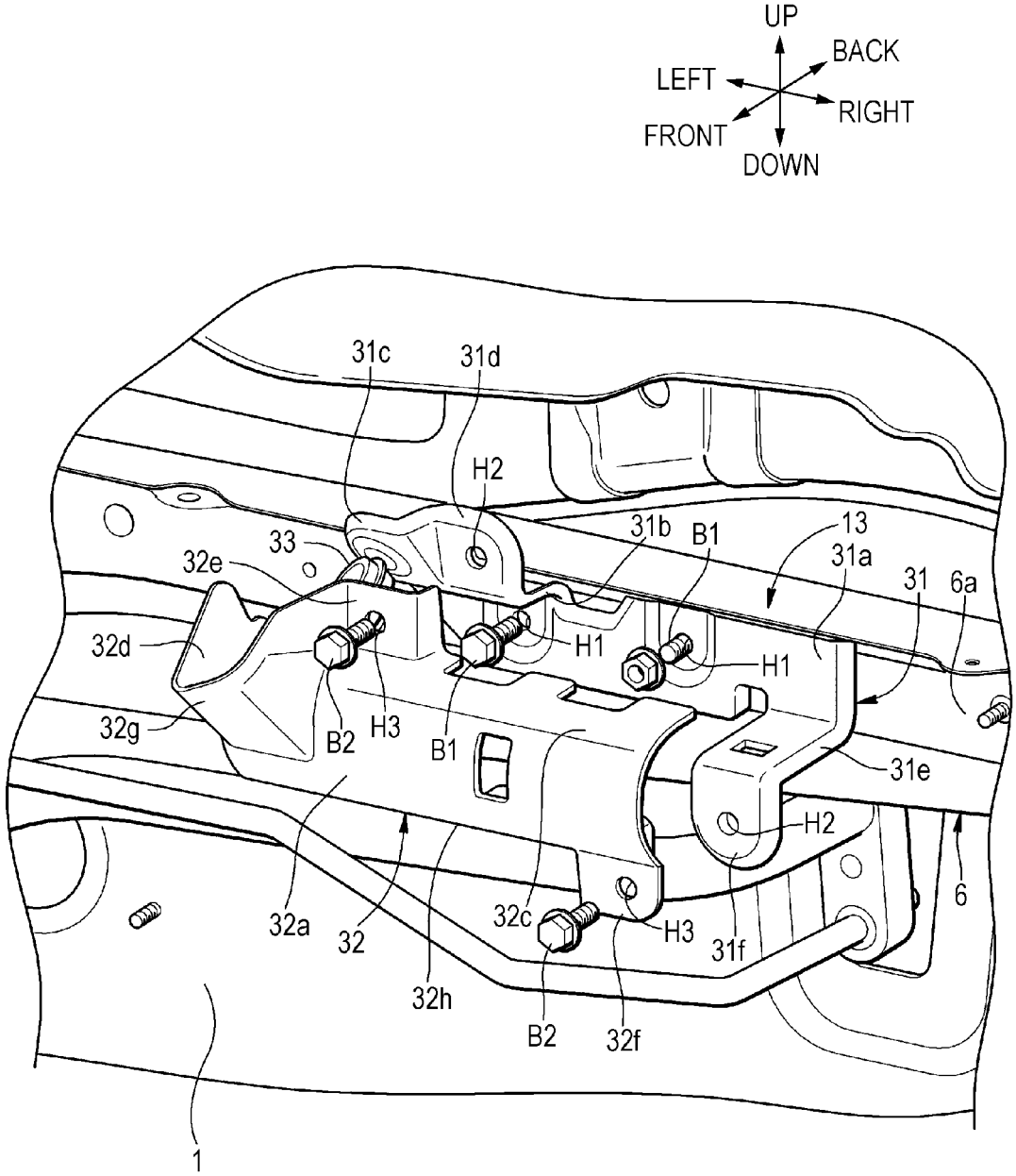
FIG. 5 is an exploded perspective view illustrating a protective member in FIG. 1.

As illustrated in FIG. 5, the protective member 13, which is included in the protective structure for the fuel pipe 10 according to the first embodiment, includes a steel base 31 fastened to the front wall 6*a* of the dashboard upper member 6 (refer to FIG. 3) by two bolts B1 and a steel cover 32 fastened to the base 31 by two bolts B2 to define a space for receiving the connection unit 12 between the base 31 and the cover 32. After the cover 32 is fixed to the base 31, the cover 32 covers the connection unit 12 from the front (such that the cover 32 is interposed between the connection unit 12 and the internal combustion engine 2), as illustrated in FIG. 3.

Figure 6:
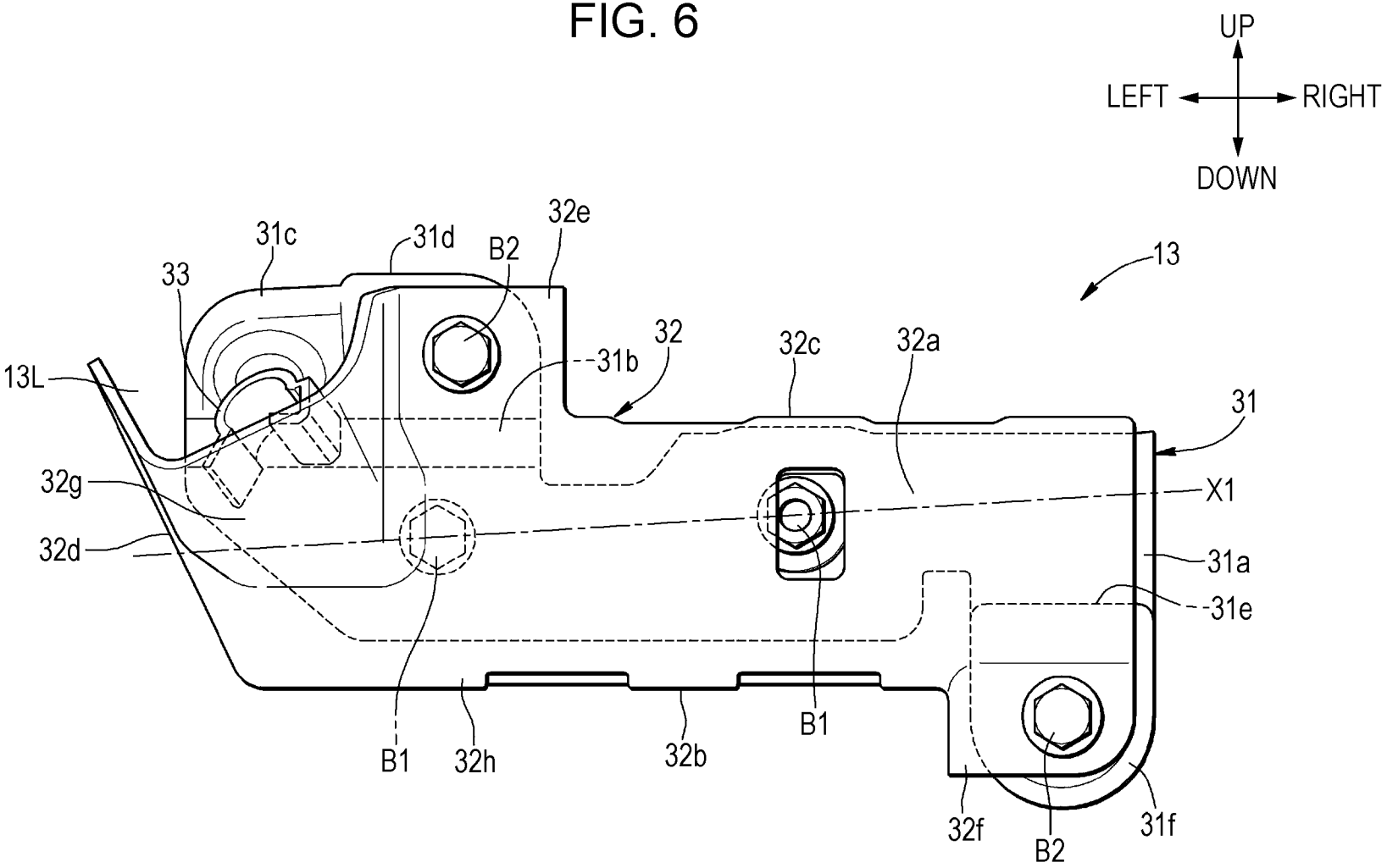
FIG. 6 is a front view of the protective member in FIG. 1.
Figure 7:
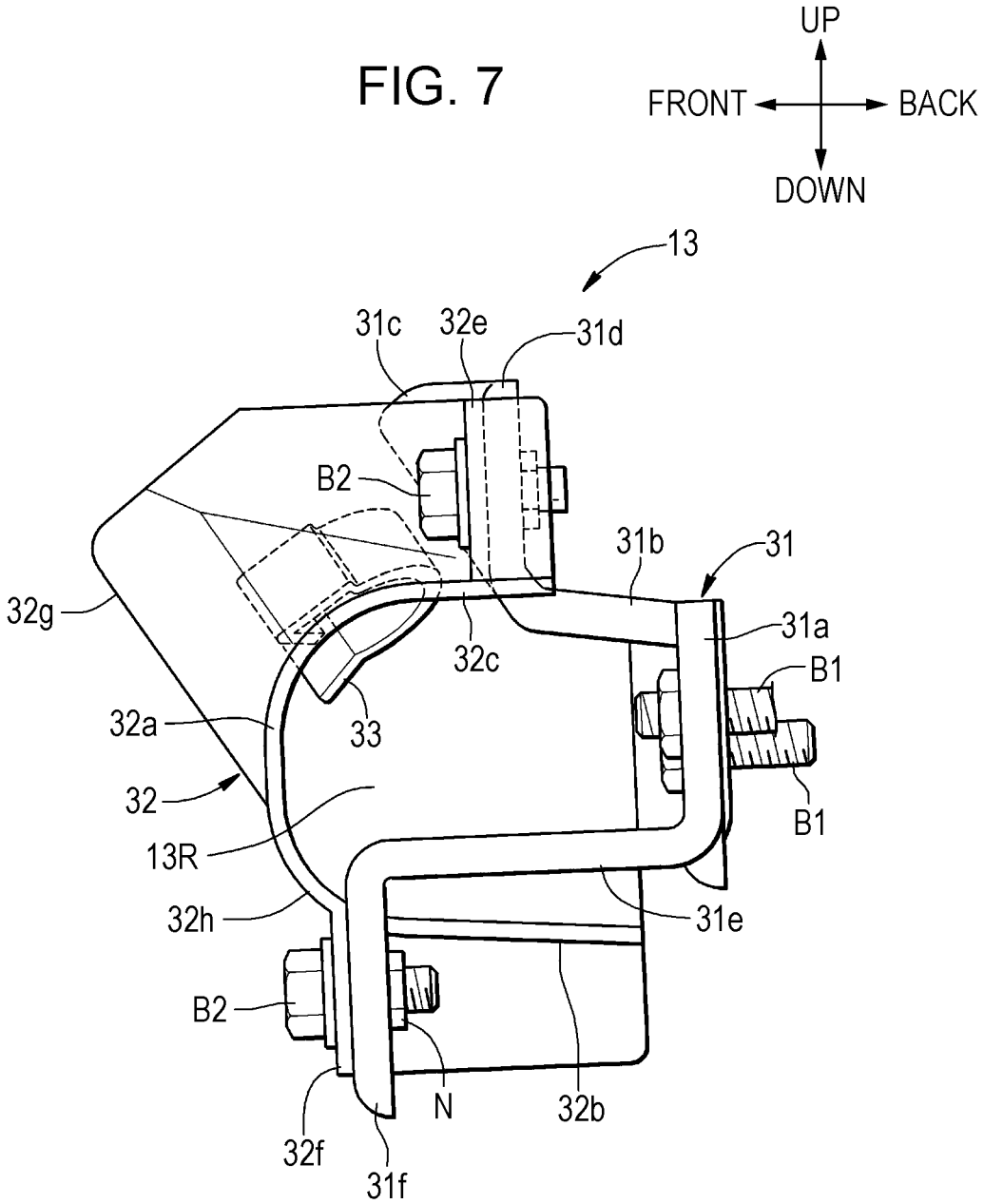
FIG. 7 is a right side view of the protective member in FIG. 1.

As illustrated in FIGS. 5 to 7, the base 31 includes a base portion 31*a*, an upper projecting portion 31*b*, a sloping portion 31*c*, an upward extending portion 31*d*, a lower projecting portion 31*e*, and a downward extending portion 31*f*. In the base 31 fixed to the dashboard upper member 6, the base portion 31*a* extends substantially vertically in the vehicle width direction. The upper projecting portion 31*b* extends forward from left part of an upper edge of the base portion 31*a*. The sloping portion 31*c* extends forward and upward from left part of a front edge of the upper projecting portion 31*b*. The upward extending portion 31*d* extends upward from right part of the front edge of the upper projecting portion 31*b* and connects to the sloping portion 31*c*. The lower projecting portion 31*e* extends forward from right end part of a lower edge of the base portion 31*a*. The downward extending portion 31*f* extends downward from a front edge of the lower projecting portion 31*e*. The base portion 31*a* has two bolt through-holes H1 arranged in substantially the middle of the base portion 31*a* in a direction along the height of the vehicle such that the bolt through-holes H1 are spaced apart from each other in the vehicle width direction. The base 31 is fastened to the dashboard upper member 6 by the two bolts B1 extending through the respective bolt through-holes H1. The sloping portion 31*c* has a rectangular hole (see FIG. 5) to which a C-shaped clip (see FIGS. 6 and 7) for holding the fuel pipe 10 is attached such that the clip faces obliquely downward. Specifically, the sloping portion 31*c* serves as a support that supports the fuel pipe 10. The sloping portion 31*c* is located above a section (where the bolts B1 and the two bolt through-holes H1 through which the bolts B1 extend are arranged) of the base 31 fixed to the dashboard upper member 6. The upward extending portion 31*d* and the downward extending portion 31*f* each have a bolt through-hole H2. A nut N (see FIG. 7) used to fix the cover 32 is secured to a rear surface of each of the upward extending portion 31*d* and the downward extending portion 31*f* by welding.

The cover 32 includes a front wall 32*a*, a lower wall 32*b*, an upper wall 32*c*, a left wall 32*d*, an upward extending wall 32*e*, and a downward extending wall 32*f*. The cover 32 protrudes forward and has an opened rear surface. In other words, the cover 32 has a laterally-facing U-shaped cross section (refer to FIG. 3). The upper wall 32*c* has a cutout, serving as the left opening 13L, in left end part thereof. In this part where the left opening 13L is provided, as illustrated in FIG. 5, the front wall 32*a* forwardly projects so as to be gradually away from the dashboard upper member 6 in an upward direction to increase an internal space of the protective member 13, thus defining a sloping wall 32*g*. The upward extending wall 32*e* is located to the right of the left opening 13L so as to face the upward extending portion 31*d* of the base 31. As illustrated in FIG. 3, the upper wall 32*c* is smoothly connected to the front wall 32*a* with no bends, except for the above-described part where the left opening 13L is disposed. The downward extending wall 32*f* extends from right end part of a lower edge of the front wall 32*a*. The front wall 32*a* is smoothly connected to the lower wall 32*b* across the entire length thereof in the vehicle width direction with no bends, except for the part from which the downward extending wall 32*f* extends. In other words, the front wall 32*a* is connected to the lower wall 32*b* by curved part 32*h*. An end of the curved part 32*h* connected to the front wall 32*a* is inclined relative to a vertical direction so as to extend obliquely forward. The cover 32 is shaped such that the sloping wall 32*g* is smoothly connected to the curved part 32*h* in side view (FIG. 7), more specifically, a lower end of the sloping wall 32*g* is connected to an upper end of the curved part 32*h*. The lower end of the sloping wall 32*g* may be connected to the curved part 32*h* at a lower level, where the curved part 32*h* is more steeply inclined, than the upper end of the curved part 32*h* (which is inclined so as to extend forward and upward and is connected to the front wall 32*a*).

Referring to FIGS. 5 and 6, each of the upward extending wall 32*e* and the downward extending wall 32*f* of the cover 32 has a bolt through-hole H3. The cover 32 is fastened to the base 31 by the two bolts B2 extending through the respective bolt through-holes H3. The left bolt through-holes H2 and H3 and the left bolt B2 are arranged at a higher level than the two bolts B1 to fasten the base 31 to the dashboard upper member 6. The lower bolt through-holes H2 and H3 and the lower bolt B2 are arranged at a lower level than the two bolts B1 to fasten the base 31 to the dashboard upper member 6. The cover 32 is secured to the base 31 such that the upward extending wall 32*e* and the downward extending wall 32*f* are in contact with the base 31.

How the above-described protective structure for the fuel pipe 10 behaves at the time of collision of the vehicle will now be described with reference to FIGS. 8A to 8D.

Figure 8A:
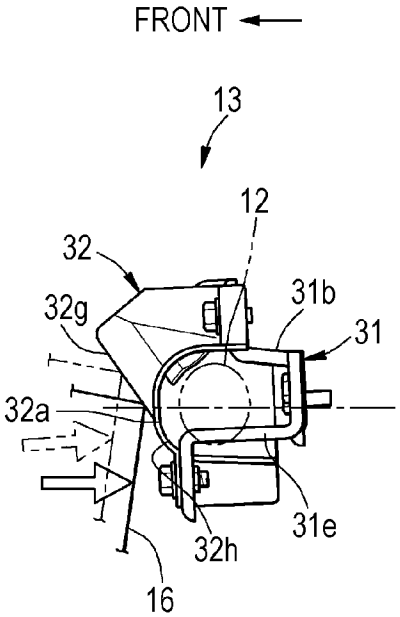
FIGS. 8A to 8D are diagrams explaining deformation of the protective member in FIG. 1 upon collision of a vehicle.
Figure 8B:
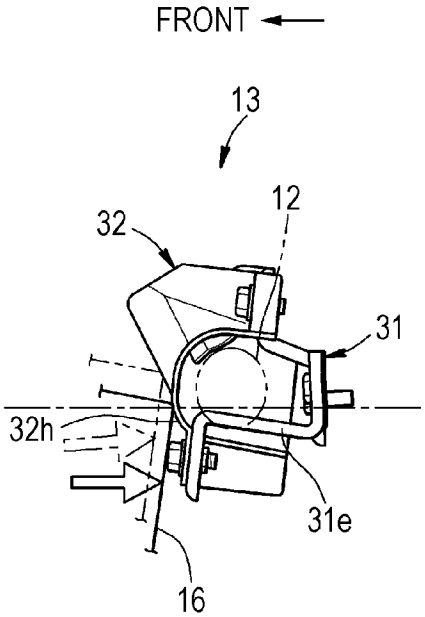

Referring to FIG. 8A, when the internal combustion engine 2 moves backward upon front collision of the vehicle, the head cover 16 comes into contact with the front wall 32*a* of the cover 32 of the protective member 13. In FIGS. 8A to 8D, a solid line indicates the internal combustion engine 2 moved horizontally backward. The upper end of the rear surface of the head cover 16 is in contact with lower part of the sloping wall 32*g*. Upward force accordingly acts on the cover 32. Consequently, the protective member 13 starts to be plastically deformed so as to shift upward as illustrated in FIG. 8B. Specifically, the sloping wall 32*g* functions as a guide to displace the connection unit 12 upward (in a receding direction in which the connection unit 12 recedes to avoid being caught by the internal combustion engine 2). Plastic deformation of the protective member 13 to upwardly displace the connection unit 12 is achieved mainly by upwardly turning the upper projecting portion 31*b* and the lower projecting portion 31*e* of the base 31.

When the internal combustion engine 2 moves upward, the upper end of the rear surface of the head cover 16 comes into contact with upper part of the sloping wall 32*g* as indicated by a phantom line. Upward force acts on the cover 32 in a manner similar to the above case. If the internal combustion engine 2 moves further upward and the upper end of the rear surface of the head cover 16 comes into contact with the protective member 13 at a level higher than an upper end of the sloping wall 32*g*, no force to cause upward deformation of the protective member 13 would be produced. It is therefore preferred that the protective member 13 be disposed at a level as high as possible.

When the protective member 13 shifts upward as illustrated in FIG. 8B, the upper end of the rear surface of the head cover 16 comes into contact with the curved part 32*h*, so that the curved part 32*h* applies upward force to the cover 32. In other words, the curved part 32*h* also functions as a guide to upwardly displace the connection unit 12.

Figure 8C:
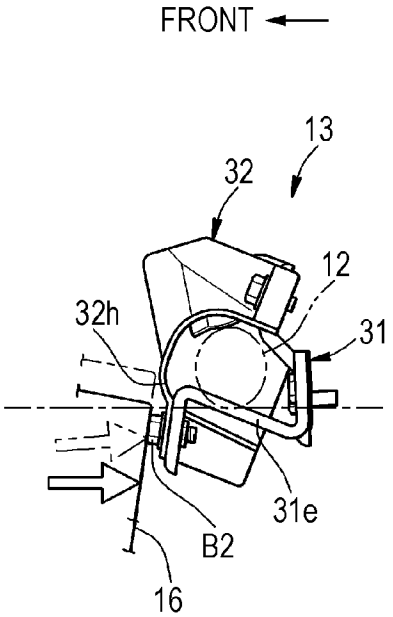
Figure 8D:
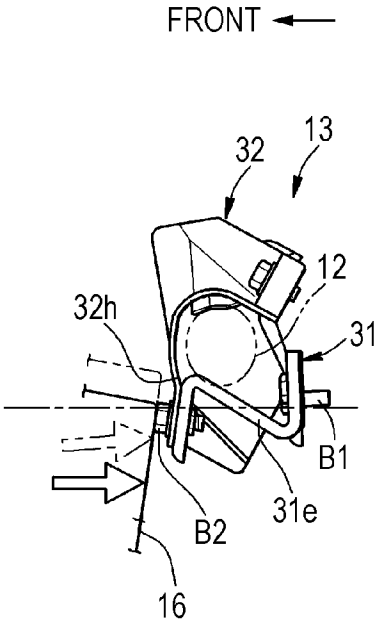

When the internal combustion engine 2 moves further backward from a position illustrated in FIG. 8B, the protective member 13 is gradually deformed plastically as illustrated in FIGS. 8C and 8D, thus further upwardly displacing the connection unit 12. Referring to FIGS. 8C and 8D, the rear surface of the head cover 16 is in contact with the lower bolt B2 to fasten the cover 32 to the base 31, thus upwardly turning the lower projecting portion 31*e* of the base 31. At this time, the lower projecting portion 31*e* of the base 31 upwardly displaces the connection unit 12 and the curved part 32*h* serves as a movement margin for plastic deformation.

In the above-described plastic deformation of the protective member 13, since the two bolts B1 to fasten the base 31 to the dashboard upper member 6 are arranged substantially horizontally as illustrated in FIG. 6, the base portion 31*a* of the base 31 tends to turn in a direction in which the cover 32 is upwardly displaced. In addition, since the lower bolt B2 of the two bolts B2 to fasten the cover 32 to the base 31 is disposed at a lower level than a line X1 extending through the two bolts B1, the cover 32 is deformed so as to upwardly turn about the lower bolt B2 such that lower part of the cover 32 does not turn outward and upward during plastic deformation of the cover 32. This facilitates upward displacement of the connection unit 12 without the connection unit 12 being exposed.

Furthermore, since the sloping portion 31*c* of the base 31 supporting the fuel pipe 10 is disposed at a higher level than the two bolts B1 to fix the base 31 to the dashboard upper member 6, the fuel pipe 10 is less likely to be broken by tension when displaced.

Second Embodiment

A protective structure for a fuel pipe 10 according to a second embodiment will now be described with reference to FIGS. 9 to 12D. The second embodiment differs from the first embodiment in the connection structures of the portions and parts of the base 31 and the cover 32 of the protective member 13. The same or similar components as those in the first embodiment are designated by the same reference numerals and the description thereof is omitted as much as possible.

Figure 9:
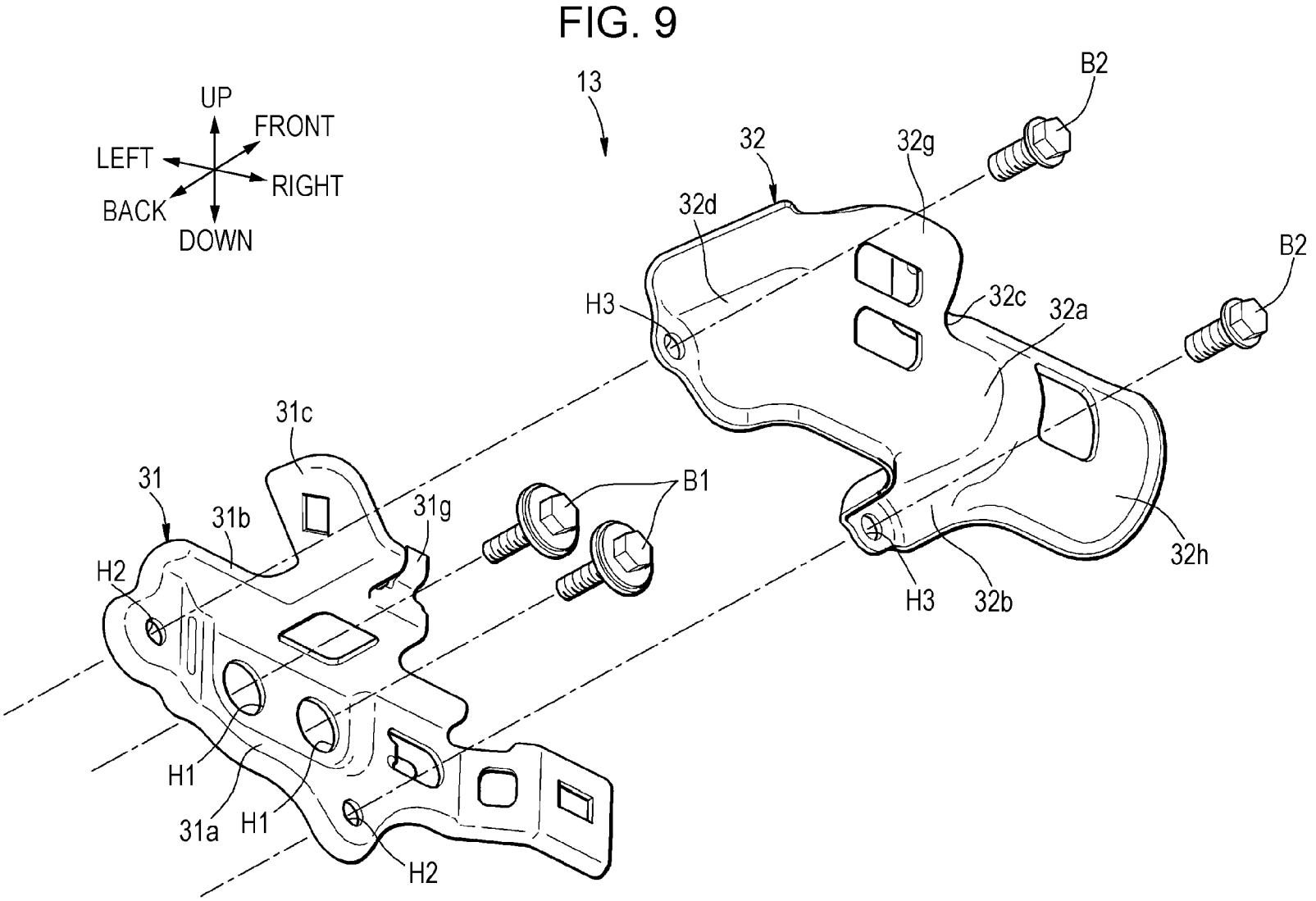
FIG. 9 is an exploded perspective view of a protective member according to a second embodiment.
Figure 10:
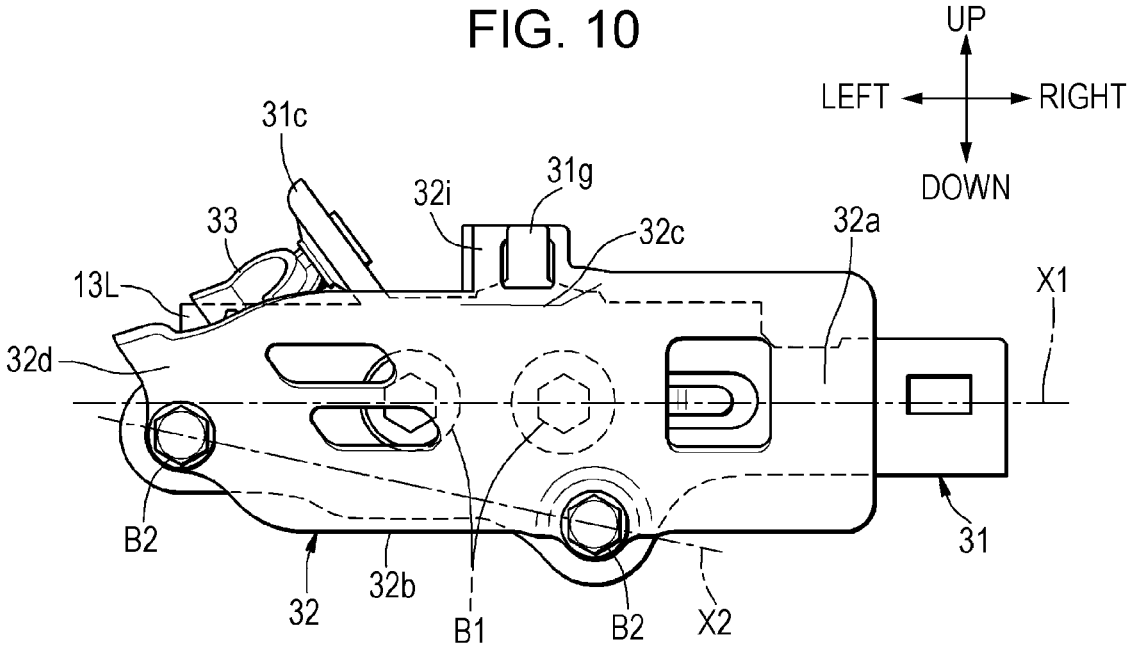
FIG. 10 is a front view of the protective member of FIG. 9.
Figure 11:
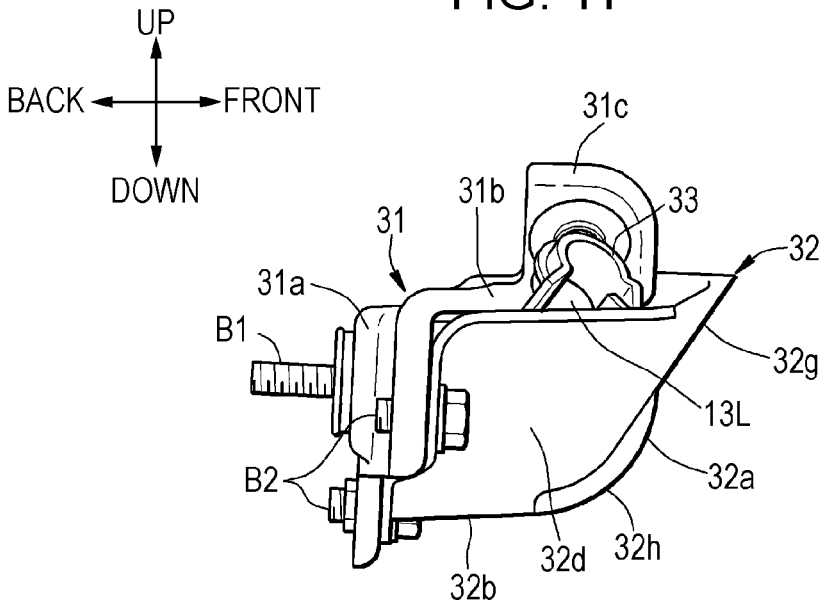
FIG. 11 is a left side view of the protective member of FIG.

As illustrated in FIGS. 9 to 11, a base 31 includes a base portion 31*a*, an upper projecting portion 31*b*, a sloping portion 31*c*, and an engagement lug 31*g*. In the base 31 fixed to a dashboard upper member 6, the base portion 31*a* extends substantially vertically in the vehicle width direction. The upper projecting portion 31*b* projects forward from middle part in the vehicle width direction of an upper edge of the base portion 31*a*. The sloping portion 31*c* extends leftward and upward from a left edge of the upper projecting portion 31*b*. The engagement lug 31*g* extends upward from a front edge of the upper projecting portion 31*b* in middle part in the vehicle width direction of the base 31. The sloping portion 31*c* has a rectangular hole (see FIG. 9) to which a C-shaped clip 33 (see FIGS. 10 and 11) for holding the fuel pipe 10 is attached such that the C-shaped clip 33 faces leftward and downward. In other words, the sloping portion 31*c* serves as a support that supports the fuel pipe 10. The sloping portion 31*c* is disposed at a higher level than a section (where two bolt through-holes H1 are arranged) of the base 31 fixed to the dashboard upper member 6. The engagement lug 31*g* engages with a cover 32 to secure upper part of the cover 32 so that the cover 32 is prevented from moving in all directions except in the upward direction.

The cover 32 includes a front wall 32*a*, a lower wall 32*b*, an upper wall 32*c*, and a left wall 32*d*. The cover 32 protrudes forward and has an opened rear surface. In other words, the cover 32 has a laterally-facing U-shaped cross section (refer to FIG. 3). The upper wall 32*c* has a cutout, serving as a left opening 13L, in left end part thereof. In this part where the left opening 13L is provided, as illustrated in FIG. 11, the front wall 32*a* forwardly projects so as to be gradually away from the dashboard upper member 6 in the upward direction to increase an internal space of a protective member 13, thus defining a sloping wall 32*g*. As illustrated in FIG. 3, the upper wall 32*c* is smoothly connected to the front wall 32*a* with no bends, except for the above-described part where the left opening 13L is disposed. Additionally, the front wall 32*a* is smoothly connected to the lower wall 32*b* across the entire length thereof in the vehicle width direction with no bends. In other words, the front wall 32*a* is connected to the lower wall 32*b* by curved part 32*h*. The cover 32 is fixed to the dashboard upper member 6 such that the lower wall 32*b* and the upper wall 32*c* slightly slope upward gradually in a forward direction.

As illustrated in FIGS. 9 and 10, the cover 32 has two bolt through-holes H3 arranged in left and lower ends of the cover 32. The cover 32 is fastened to the base 31 by two bolts B2 extending through the respective bolt through-holes H3. The bolt through-hole H3 and the bolt B2 in the left end of the cover 32 are arranged at a slightly lower level than two bolts B1 to fasten the base 31 to the dashboard upper member 6. The bolt through-hole H3 and the bolt B2 in the lower end of the cover 32 are arranged at a level lower than the two bolts B1 to fasten the base 31 to the dashboard upper member 6 and are located toward the right of the right bolt B1. The cover 32 further includes an engagement tab 32*i* in substantially middle part thereof in the vehicle width direction. The engagement tab 32*i* extends upward from a rear end of the upper wall 32*c* and has a rectangular hole. The engagement lug 31*g* of the base 31 is inserted into the rectangular hole of the cover 32 in a tilted state such that the engagement lug 31*g* engages with the engagement tab 32*i*, the cover 32 is pivoted about the engagement tab 32*i* such that lower part of the cover 32 moves to the base 31 (backward), and the cover 32 is fastened to the base 31 by the two bolts B2.

How the above-described protective structure for the fuel pipe 10 behaves at the time of collision of the vehicle will now be described with reference to FIGS. 12A to 12D.

Figure 12A:
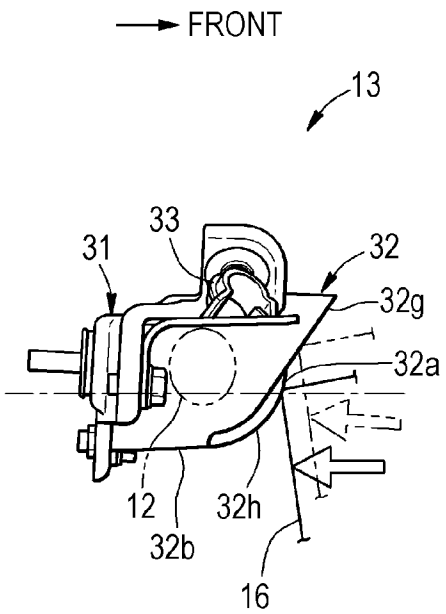
FIGS. 12A to 12D are diagrams explaining deformation of the protective member of FIG. 9 upon collision of the vehicle.
Figure 12B:
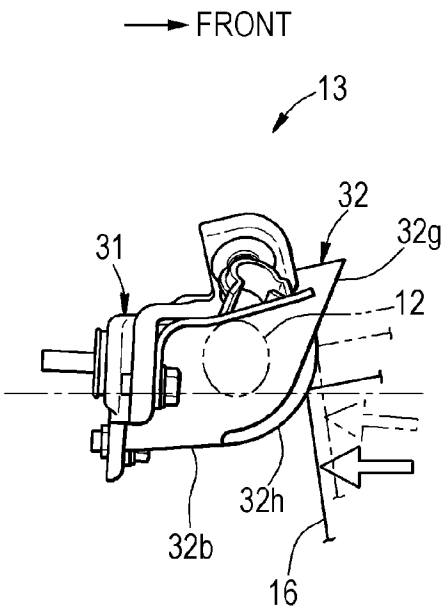

Referring to FIG. 12A, when an internal combustion engine 2 moves backward upon front collision of the vehicle, a head cover 16 comes into contact with the front wall 32*a* of the cover 32 of a protective member 13. In FIGS. 12A to 12D, a solid line indicates the internal combustion engine 2 moved horizontally backward. An upper end of a rear surface of the head cover 16 is in contact with upper part of the curved part 32*h*. Since the lower wall 32*b* and the upper wall 32*c* of the cover 32 slope upward and forward, upward force accordingly acts on the cover 32. Consequently, the protective member 13 starts to be plastically deformed so as to shift upward as illustrated in FIG. 12B. Specifically, the curved part 32*h* functions as a guide to displace a connection unit 12 upward (in the receding direction in which the connection unit 12 recedes to avoid being caught by the internal combustion engine 2).

When the internal combustion engine 2 moves upward, the upper end of the rear surface of the head cover 16 comes into contact with the sloping wall 32*g* as indicated by a phantom line. Upward force acts on the cover 32 in a manner similar to the above case. When the protective member 13 shifts upward as illustrated in FIG. 12B, the upper end of the rear surface of the head cover 16 is in contact with the curved part 32*h*, so that the curved part 32*h* applies upward force to the cover 32. In other words, the sloping wall 32*g* and the curved part 32*h* function as a guide to upwardly displace the connection unit 12.

If the internal combustion engine 2 moves further upward and the upper end of the rear surface of the head cover 16 comes into contact with the protective member 13 at a level higher than an upper end of the sloping wall 32*g*, no force to cause upward deformation would be produced. It is therefore preferred that the protective member 13 be disposed at a level as high as possible.

Figure 12C:
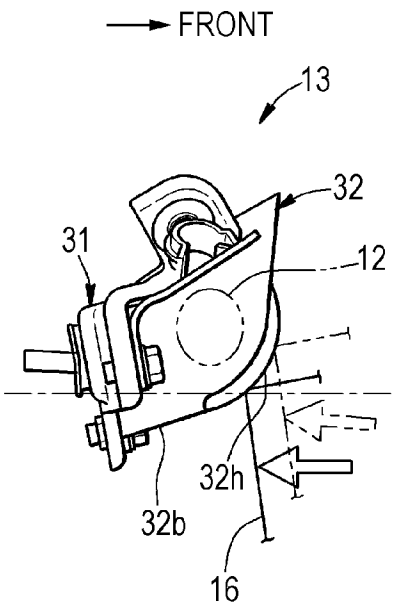
Figure 12D:
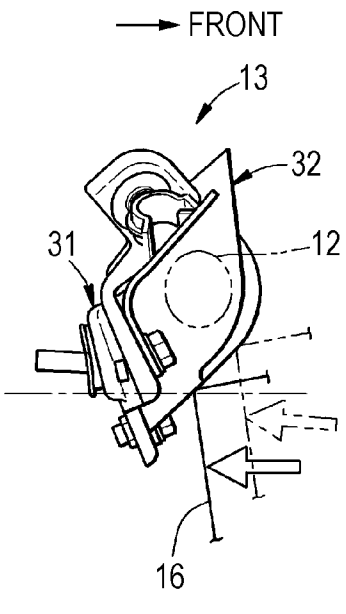

When the internal combustion engine 2 moves further backward from a position illustrated in FIG. 12B, the protective member 13 is gradually deformed plastically as illustrated in FIGS. 12C and 12D, thus further upwardly displacing the connection unit 12. Referring to FIGS. 12C and 12D, the upper end of the rear surface of the head cover 16 comes into contact with lower part of the curved part 32*h* and then comes into contact with the lower wall 32*b*. The curved part 32*h* smoothly connected to the lower wall 32*b* displaces the connection unit 12 smoothly upward and also serves as a movement margin for plastic deformation.

In the above-described plastic deformation of the protective member 13, since the two bolts B1 to fasten the base 31 to the dashboard upper member 6 are arranged substantially horizontally as illustrated in FIG. 10, the base portion 31*a* of the base 31 tends to turn in a direction in which the cover 32 is upwardly displaced. In addition, since the two bolts B2 to fasten the cover 32 to the base 31 are arranged at a lower level than a line X1 extending through the two bolts B1, the cover 32 is deformed so as to upwardly turn about a line X2 extending through the two bolts B2 such that lower part of the cover 32 does not turn outward and upward during plastic deformation of the cover 32. This facilitates upward displacement of the connection unit 12 without the connection unit 12 being exposed.

Furthermore, since the sloping portion 31*c* of the base 31 supporting the fuel pipe 10 is disposed at a higher level than the two bolts B1 to fix the base 31 to the dashboard upper member 6, the fuel pipe 10 is less likely to be broken by tension when displaced.

The above-described embodiments are for illustrative purposes only, and should not be construed as limiting. Alterations, modifications, and variations may be effected to the particular embodiments by those skilled in the art without departing from the scope of the present disclosure. For example, although the feed hose 11 is connected to the upstream end of the fuel pipe 10 by the connection unit 12 in the above-described embodiments, a connection is not limited to the connection unit 12. The connection may be any connection between fuel supply components, such as a connection between the fuel pipe 10 and a flow control valve. Although the embodiments have been described with respect to the case where the present disclosure is applied to a front-engine vehicle, the present disclosure can be applied to a rear-engine vehicle in which the internal combustion engine 2 is mounted in rear part of a vehicle body. In this case, the fuel pipe 10 is disposed in front of the internal combustion engine 2. Although the embodiments have been described with respect to the case where the protective member 13 is configured to upwardly displace the connection unit 12 upon collision of the vehicle, the receding direction in which the connection unit 12 is displaced is not limited to the upward direction. The connection unit 12 may be displaced downward, leftward, or rightward. As regards materials for the base 31 and the cover 32, the base 31 may be made of a material having stiffness higher than that of a material for the cover 32. Although the embodiments have been described with respect to the case where the internal combustion engine 2 directly collide with the protective member 13 upon collision of the vehicle, the internal combustion engine 2 may indirectly collide with the protective member 13. An auxiliary device of the internal combustion engine 2 or a component moved in response to movement of the internal combustion engine 2 may collide with the protective member 13. In addition, a specific structure of each component or part, arrangement of the components and parts, the number of components or parts, and angles of the components and parts may be changed as appropriate without departing from the scope of the present disclosure. Furthermore, all of the components of the protective structure for the fuel pipe 10 described in the embodiments are not absolutely needed. The components thereof may be selected as appropriate.

According to an aspect of the present application, a fuel pipe protective structure includes a fuel pipe 10 having a first end connected to an internal combustion engine 2 mounted in an engine compartment 1 of a vehicle and a second end disposed closer to a vehicle interior than the internal combustion engine 2, a connecting member (feed hose 11) connected to the second end of the fuel pipe 10, and a protective member 13 that protects a connection (connection unit 12) between the fuel pipe 10 and the connecting member 11. The protective member 13 includes a base 31 fixed to a vehicle body wall (dashboard upper member 6) that defines the engine compartment 1 and a cover 32 interposed between the connection 12 and the internal combustion engine 2 so as to cover the connection. The cover 32 includes a guide 32*g*, 32*h* that causes the protective member to be plastically deformed in order to displace the connection 12 in a receding direction (upward direction) in which the connection recedes to avoid being caught by the internal combustion engine 2 when the internal combustion engine 2 moves toward the vehicle interior upon collision of the vehicle.

In this structure, if the connection between the fuel pipe and the connecting member has low strength, the connection can be protected by the cover at the time of collision of the vehicle, thus preventing breakage of the connection and leakage of fuel from the connection. In addition, since the guide of the cover displaces the connection in the receding direction, the position of the connection is free from restriction, thus providing high flexibility of layout.

In this aspect, the guide may include a sloping wall 32*g* that is at least part of the cover 32 extending outwardly so as to be gradually away from the vehicle body wall 6 in the receding direction (upward direction), and curved part 32*h* formed by curving part of the cover 32 facing in a direction (downward direction) opposite to the receding direction (upward direction).

In this structure, the sloping wall functions as a guiding member and ensures the displacement of the connection. Additionally, the curved part can smoothly displace the connection upon collision of the vehicle and provide a movement margin for plastic deformation.

In this aspect, the cover 32 may be secured to the base 31 by a plurality of fasteners B2, H3 and at least one of the fasteners B2, H3 is disposed on an opposite side (lower side) of a section B1, H1 of the base 31 fixed to the vehicle body wall 6 from part of the base 31 extending in the receding direction (upward direction).

In this structure, the cover can be prevented from turning outward and upward. Additionally, the cover can be plastically deformed so as to turn about the fastener disposed on the opposite side of the section of the base fixed to the vehicle body wall from the part of the base extending in the receding direction. Thus, the connection can be more smoothly displaced in the receding direction.

In this aspect, the base 31 may include a support (sloping portion 31*c*) that supports the fuel pipe 10. The support 31*c* may be disposed adjacent to the part of the base 31 extending in the receding direction (upward direction) relative to the section B1, H1 of the base 31 fixed to the vehicle body wall 6.

In this structure, the fuel pipe can be prevented from being broken by tension when displaced.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel pipe protective structure comprising:

a fuel pipe having a first end connected to an internal combustion engine mounted in an engine compartment of a vehicle and a second end disposed closer to a vehicle interior than the internal combustion engine in a direction from a front of the vehicle to a rear of the vehicle;

a connecting member connected to the second end of the fuel pipe; and a protective member that protects a connection between the fuel pipe and the connecting member, the protective member including a base fixed to a vehicle body wall that defines the engine compartment, and a cover interposed between the connection and the internal combustion engine so as to cover the connection, the cover including a guide that is configured to cause the protective member to be plastically deformed in order to displace the connection in a receding direction in which the connection recedes to avoid being caught by the internal combustion engine when the internal combustion engine moves toward the vehicle interior upon collision of the vehicle, wherein the connection is disposed between the base and the cover of the protective member in the direction from the front of the vehicle to the rear of the vehicle.

2. The protective structure according to claim 1, wherein the guide includes a sloping wall that is at least part of the cover extending outwardly so as to extend gradually away from the vehicle body wall in the receding direction, and a curved part formed by curving part of the cover facing in a direction opposite to the receding direction.

3. The fuel pipe protective structure according to claim 1, wherein the cover is secured to the base by a plurality of fasteners and at least one of the fasteners is disposed on an opposite side of a section of the base fixed to the vehicle body wall from part of the base extending in the receding direction.

4. The fuel pipe protective structure according to claim 3, wherein the base includes a support that supports the fuel pipe and the support is disposed adjacent to the part of the base extending in the receding direction relative to the section of the base fixed to the vehicle body wall.

5. The fuel pipe protective structure according to claim 1, wherein the cover has a U-shaped cross section, and the connection is disposed in a central portion of the U-shaped cross section that faces the base in the direction from the front of the vehicle to the rear of the vehicle.

6. The fuel pipe protective structure according to claim 1, wherein the base is directly fixed to the vehicle body wall.

7. The fuel pipe protective structure according to claim 1, wherein the connection and the protective member are disposed behind the internal combustion engine in the direction from the front of the vehicle to the rear of the vehicle.

8. A fuel pipe protective structure comprising:

a fuel pipe having a first end to be connected to an internal combustion engine mounted in an engine compartment of a vehicle and a second end disposed closer to a vehicle interior than the internal combustion engine in a direction from a front of the vehicle to a rear of the vehicle;

a connecting member connected to the second end of the fuel pipe; and a protective member to protect a connection between the fuel pipe and the connecting member, the protective member comprising:

a base to be connected to a vehicle body wall that defines the engine compartment; and a cover to be interposed between the connection and the internal combustion engine so as to cover the connection, the cover comprising:

a guide configured to cause the protective member to be plastically deformed in order to displace the connection in a receding direction in which the connection moves to avoid being caught by the internal combustion engine in a case where the internal combustion engine moves toward the vehicle interior upon collision of the vehicle, wherein the connection is disposed between the base and the cover of the protective member in the direction from the front of the vehicle to the rear of the vehicle.

9. The protective structure according to claim 8, wherein the guide includes a sloping wall comprising at least part of the cover extending outwardly so as to extend gradually away from the vehicle body wall in the receding direction, and a curved part provided by curving part of the cover facing in a direction opposite to the receding direction.

10. The fuel pipe protective structure according to claim 8, wherein the cover is secured to the base by a plurality of fasteners and at least one of the plurality of fasteners is disposed on an opposite side of a section of the base connected to the vehicle body wall from part of the base extending in the receding direction.

11. The fuel pipe protective structure according to claim 10, wherein the base includes a support that supports the fuel pipe and the support is disposed adjacent to the part of the base extending in the receding direction relative to the section of the base connected to the vehicle body wall.

12. The fuel pipe protective structure according to claim 8, wherein the base is connected to the vehicle body wall by a first fastener, and the cover is connected to the base by second and third fasteners, and wherein the second fastener is provided at a higher level than the first fastener in a vertical direction, and the third fastener is provided at a lower level than the first fastener in the vertical direction.

13. The fuel pipe protective structure according to claim 8, wherein the cover has a U-shaped cross section, and the connection is disposed in a central portion of the U-shaped cross section that faces the base in the direction from the front of the vehicle to the rear of the vehicle.

14. The fuel pipe protective structure according to claim 8, wherein the base is configured to be directly fixed to the vehicle body wall.

15. The fuel pipe protective structure according to claim 8, wherein the connection and the protective member are configured to be disposed behind the internal combustion engine in the direction from the front of the vehicle to the rear of the vehicle.

16. A vehicle comprising:

an internal combustion engine mounted in an engine compartment;

a vehicle body wall disposed at an outer periphery of the engine compartment;

a vehicle interior disposed behind the engine compartment; and a fuel pipe protective structure including a fuel pipe having a first end connected to the internal combustion engine and a second end disposed closer to the vehicle interior than the internal combustion engine;

a connecting member connected to the second end of the fuel pipe; and a protective member that protects a connection between the fuel pipe and the connecting member, the protective member including a base fixed directly to the vehicle body wall, and a cover interposed between the vehicle body wall and the internal combustion engine so as to cover the connection, the cover including a guide that is configured to cause the protective member to be plastically deformed in order to displace the connection in a receding direction in which the connection recedes to avoid being caught by the internal combustion engine when the internal combustion engine moves toward the vehicle interior upon collision of the vehicle.

17. The fuel pipe protective structure according to claim 16, wherein the cover has a U-shaped cross section, and the connection is disposed in a central portion of the U-shaped cross section that faces the base in a direction from the front of the vehicle to the rear of the vehicle.

18. The vehicle according to claim 16, wherein the connection and the protective member are disposed behind the internal combustion engine in the direction from the front of the vehicle to the rear of the vehicle.

* * * * *